US005482533A

United States Patent [19]

Masuda et al.

[11] Patent Number: 5,482,533

[45] Date of Patent: Jan. 9, 1996

[54] METHOD FOR MANUFACTURING FOAM ALUMINUM PRODUCT AND PRODUCT

[75] Inventors: Toshio Masuda, Ashikaga; Shigemi Kanbayashi, Gunma Pref, both of Japan

[73] Assignee: Fuji Jukogyo Kabushiki Kaisha, Tokyo, Japan

[21] Appl. No.: 202,366

[22] Filed: Feb. 25, 1994

Related U.S. Application Data

[63] Continuation-in-part of Ser. No. 175,741, Dec. 30, 1993, abandoned.

[30] Foreign Application Priority Data

Jan. 12, 1993 [JP] Japan ..... 19645

[51] Int. Cl.[6] ..... B22D 27/00

[52] U.S. Cl. ..... 75/415; 29/417; 29/527.5; 29/527.6; 164/79; 428/613

[58] Field of Search ..... 29/527.5, 527.6, 29/417; 164/79; 75/415; 428/613

[56] References Cited

U.S. PATENT DOCUMENTS 3,848,666 11/1974 Valdo ..... 165/168
5,281,251 1/1994 Kenny et al. ..... 75/415

*Primary Examiner*—Melvyn Andrews
*Attorney, Agent, or Firm*—Beveridge, DeGrandi, Weilacher & Young

[57] ABSTRACT

A method is disclosed for forming a foamed aluminum article. A foaming vessel is used including a peripheral wall and a plurality of vertical rod members to form mounting holes at given positions in the vicinity of the inside surface of the peripheral wall. The melt of aluminum or its alloy is stirred with a viscosity increaser and a foaming material. The solidified aluminum block is then sliced to a given thickness to obtain a product of foamed aluminum having mounting holes in given positions in the vicinity of the outer edge thereof. A hard portion around the holes is used as the surface site for mounting the product. The products are used for sound and heat insulation.

11 Claims, 2 Drawing Sheets

METHOD FOR MANUFACTURING FOAM ALUMINUM PRODUCT AND PRODUCT

REFERENCE TO A RELATED APPLICATION

This application is a continuation-in-part of our application Ser. No. 08/175,741 filed Dec. 30, 1993, now abandoned which is relied on and incorporated by reference.

BACKGROUND OF THE INVENTION

The present invention relates to a method of making foamed aluminum products to be used as sound-absorbing or heat-insulating materials.

Foamed aluminum is capable of absorbing sound or insulating heat, and so is used in the form of sound insulating walls for freeways as an example.

The foamed aluminum has a cell structure comprising cells of uniform shape, and is prepared by melting aluminum (Al) or alloys thereof, as shown in FIG. 2A, stirring the melt with a specific amount of calcium (Ca) added as a viscosity increaser for increasing the viscosity of the melt, re-stirring the melt with a specific amount of hydrogenated titanium ($TiH_2$) added as a foaming agent, as shown in FIG. 2B, for foaming the melt in a closed state. For instance, see Japanese Patent Application Laid-open No. JP-B-1-51528.

Foamed metals including foamed aluminum are generally formed from a melt in a vessel, and an important point is to what degree a stable and uniform structure (density) is developed the resulting foamed structure. As is known in the prior art, a block a of foamed aluminum is formed in a conventional vessel, as shown in FIG. 2C. Then, only a region b having a relatively stable structure and desired density, located at the middle of the vessel, is cut out of the block a for use. A (hatched) region c having an insufficient degree of foaming (high density and high strength), located in the vicinity of the inner wall of the vessel, is unsuitable for sound-absorbing or heat-insulating material, and so is rejected or discarded. This makes the yield of conventional methods very low. It is also very troublesome to cut out only the middle region b suitable for sound-absorbing or heat-insulating material and to make products therefrom.

An object of the present invention is to provide a method of producing foamed aluminum products having reasonable sound-absorbing and heat-insulating properties and possessing the local strength and rigidity needed for mounting, and fastening which makes intentional use of both uniform and non-uniform structures obtained at the foaming step, thereby providing a solution to the problems encountered with conventional methods.

SUMMARY OF THE INVENTION

In achieving the above and other objects, a feature of the present invention resides in employing a foaming vessel having a peripheral wall conforming in its inside surface to the outer configuration of the desired foamed aluminum product to be produced and a plurality of vertical rod members to form mounting holes, which are fixed at locations in the vessel at least at given positions in the vicinity of the inside surface of the peripheral wall. In carrying out the invention, a melt of aluminum or alloy thereof is formed, stirred with a viscosity increaser and a foaming material, and is foamed in the customary manner in the vessel. After cooling to form a block of foamed aluminum, the block is sliced to a given thickness as desired to obtain a flat layer or panel product of foamed aluminum having mounting holes at least in given positions in the vicinity of the outer edge of the product. The products obtained by the above described method are another feature of the invention.

The regions of the product around the mounting hole have a low degree of foaming and are harder and more dense than the rest of the product, so that the product can have strength and rigidity enough to enable it to be mounted directly on an associated portion with the use of mounting bolts but with no need of special mounting tools. The rest of the product has a desired stable degree of foaming and possesses excellent sound-absorbing and heat-insulating properties, so that the product can play its own role in absorbing sound and insulating heat. This enables the problems with conventional methods, i.e., low yields and the difficult with which products are produced, to be well solved.

BRIEF DESCRIPTION OF THE DRAWINGS

The present invention will now be explained, more specifically but not exclusively, with reference to the accompanying drawings, in which.

DETAILED DESCRIPTION OF THE INVENTION

One embodiment of the present invention will now be explained with reference to FIGS. 1A–C.

Figure 1A:
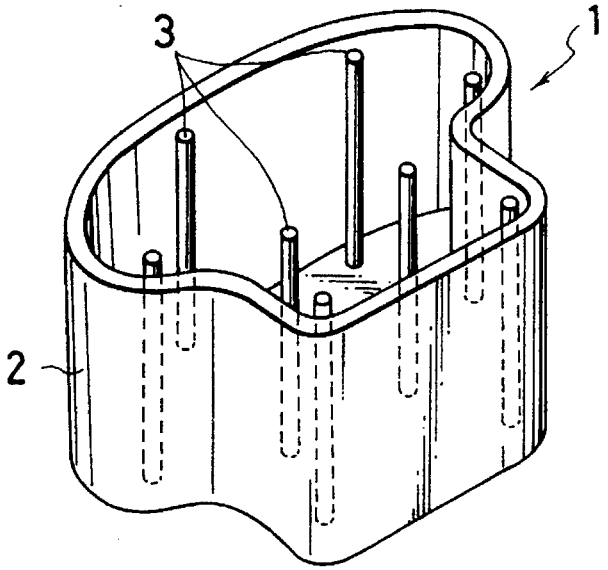
FIG. 1A is a perspective view showing one embodiment of the foaming vessel used in the invention.
Figure 1B:
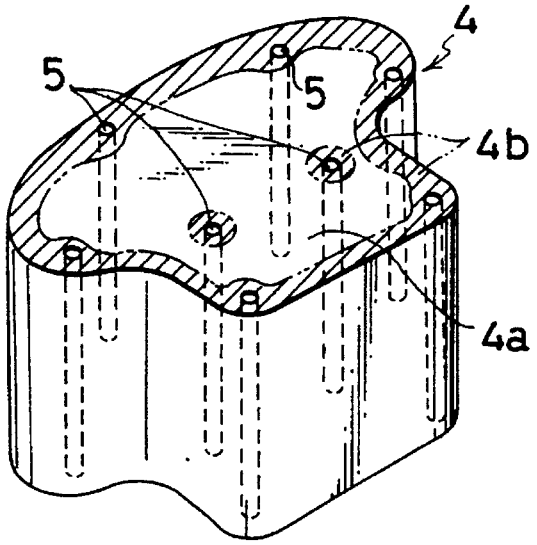
FIG. 1B is a perspective view of a block of foamed aluminum in a foaming vessel produced according to the invention.
Figure 1C:
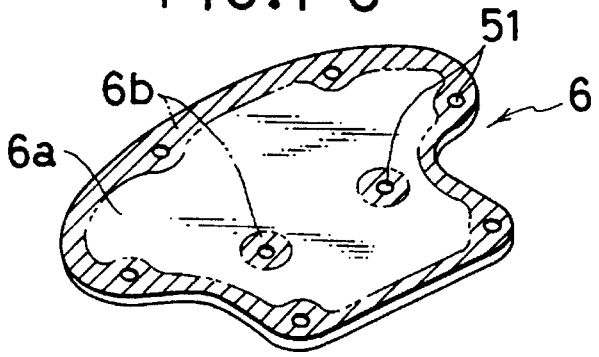
FIG. 1C is a perspective view of a product according to the invention obtained by slicing the block of foamed aluminum.
Figure 2A:
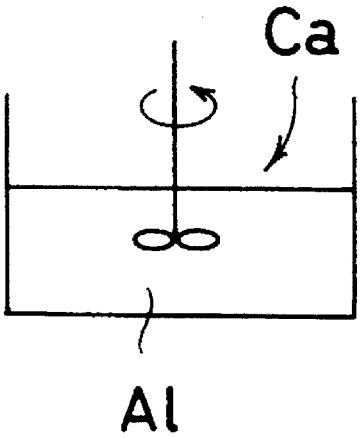
FIG. 2A is a schematic of a first step of adding a viscosity increaser (Ca)
Figure 2B:
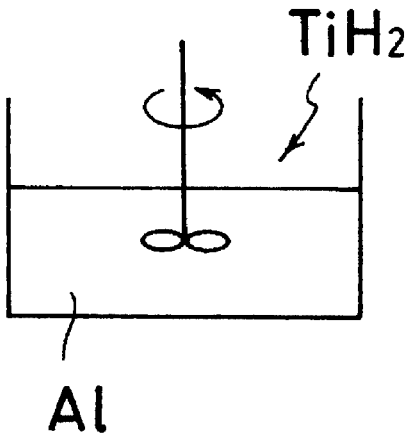
FIG. 2B is a schematic of the second step of adding a foaming material ($TiH_2$) to the melt for re-stirring.
Figure 2C:
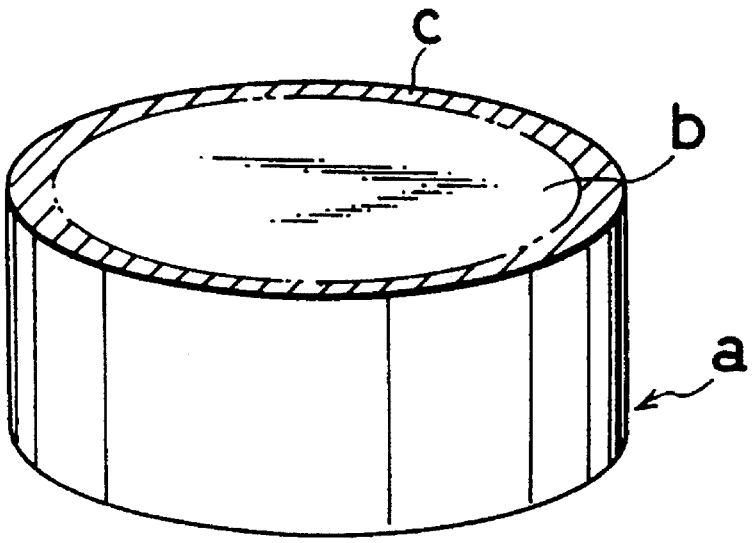
FIG. 2C is a schematic of a block of foamed aluminum obtained by foaming and cooling the melt according to conventional methods.

In the embodiment shown in FIGS. 1A–1C, an undercover to be mounted on the lower portion of the engine compartment of a car body is typically built up of foamed aluminum.

As shown in FIG. 1A, a foaming vessel 1 includes a peripheral wall 2 with the inner side having a given height and conforming in sectional shape to the outer configuration of the product to be produced (the undercover in this embodiment), and a plurality of vertical rod (pipe) members 3 which are fixed at positions substantially along the inside of the peripheral wall of the vessel, on given positions at the middle of the vessel, and in parallel with the inside of the peripheral wall of the vessel.

The vessel shown in FIG. 1A can be made of steel lined with refractory material as is well known in the art.

As in the prior art, a melt of aluminum (or an aluminum alloy), stirred with a given amount of calcium (Ca) added as a viscosity increaser for increasing viscosity and restirred with a given amount of hydrogenated titanium ($TiH_2$) as a foaming agent, is located in the foaming vessel 1 mentioned above for foaming. Such viscosity increasers and foaming agents are known in the art as are the techniques for using them. Following this, the foamed aluminum is cooled down to normal temperature, and then removed out of the foaming vessel 1, thereby obtaining a block 4 of foamed aluminum such as that shown in FIG. 1B. As can be seen in FIG. 1B, the block 4 of foamed aluminum has a plurality of through holes 5 corresponding to the vertical rod (pipe) members 3 which are fixed at positions in the vessel 1.

This block 4 of foamed aluminum conforms in outer shape to the outer configuration of the undercover to be produced and includes a plurality of vertical through-holes 5 in the vicinity of both the outer surface and at selected locations in the middle. The block 4 of foamed aluminum obtained by foaming in the foaming vessel 1 is made up of a region **4*a* which is located at the middle of the foaming vessel 1, and has a stable degree of foaming and therefore the desired density and so possesses sufficient sound-absorbing and heat-insulating properties, and (hatched) regions 4*b* located adjacent to the inside of the peripheral wall 2 of the vessel and the outer sides of the rod members 3 or the peripheral region of the foamed aluminum block 4 as well as the regions of the block 4 located around the holes 5, which have a low degree of foaming or high density and are more rigid than the region 4*a*** mentioned above, and so are unsuitable for absorbing sound and insulating heat.

Then, the foamed aluminum block 4 mentioned above is sliced to a suitable thickness from the planes vertical to its axial direction, thereby obtaining such a layer or panel product as shown in FIG. 1C, i.e, an undercover 6 for the automobile engine compartment. The thus obtained undercover 6 of foamed aluminum includes a plurality of areas, **6*b***, which have a low degree of foaming and high density and are hard and so are unsuitable for sound-absorbing or heat-insulating material, but are suitable as the portion (or surface site) for mounting the product. This also makes it possible to increase the yield of producing foamed aluminum products and reduce the cost of making them. When mounted in place, the foamed aluminum panel product according to the invention can be attached directly to an associated portion, such as the automobile body, with the use of the mounting holes formed therein but with no need of using fittings for reinforcing the peripheries of the mounting holes. This enables the number of parts involved to be reduced and mounting to be easily achieved.

Thus, as will be seen from the foregoing, the foamed aluminum panels produced in accordance with the method of the invention have an outer edge with a region of relatively dense aluminum foam proximate said edge and forming a continuous band along the edge of said panel. A plurality of holes are located in said proximate edge region, said holes being dimensioned according to fastening means to be used to fasten the panel to its intended location. Also, the panels as shown in FIG. 1C preferably have a plurality of relatively small regions of relatively high density located at sites in the central region of the panel of relatively low density **6*a*. This plurality of small regions also have holes 51** formed therein to accommodate fastening devices.

While the presently preferred embodiments of the present invention have been shown and described, it is to be understood these disclosures are for the purpose of illustration and that various changes and modifications may be made without departing from the scope of the invention as set forth in the appended claims.

What is claimed is:

1. A manufacturing method for making a foamed aluminum product, comprising:

placing a plurality of vertical rod members which are fixed at locations in a vessel having a peripheral wall conforming on its inside surface to the outer configuration of the foamed aluminum product, at least some of which rods are located at positions close to an inner wall of said vessel;

pouring a melt of aluminum or an alloy thereof into said vessel;

stirring said melt with a viscosity increaser for increasing the viscosity of said melt and a foaming agent for foaming said melt;

cooling said melt to form a block of foamed aluminum or alloy thereof;

removing said block from said vessel; and slicing said block to a predetermined thickness in a plane vertical to its axial direction to obtain a product of foamed aluminum or aluminum alloy having a plurality of mounting holes surrounded by a high density area at least in a position in the vicinity of the outer edge thereof.

2. The method according to claim 1, wherein said rod member is a pipe.

3. The method according to claim 1, wherein said viscosity increaser is calcium.

4. The method according to claim 1 wherein said foaming agent is $TiH_2$.

5. A foamed aluminum panel formed by the method according to claim 1.

6. The foamed aluminum panel according to claim 5 in a shape conforming to the automobile engine compartment to which said foamed aluminum panel is fitted to provide heat and sound insulation.

7. A foamed aluminum panel having an edge, a region along a peripheral edge of relatively high density and a central region other than said region along said peripheral edge, of relatively low density, a plurality of holes located in said region along said peripheral edge for attachment to the intended location of the panel to provide sound and heat insulation.

8. The panel according to claim 7 further comprising a plurality of centrally located regions of relatively high density having holes for fastening.

9. A manufacturing method for making a foamed aluminum product in a vessel having a peripheral wall with an open end at an upper side of said vessel, said vessel further containing a plurality of fixed, vertical cylindrical rod members on the bottom of said vessel, at least some of said rods being fixed at a position close to the inside of said peripheral wall of said vessel comprising;

pouring molten metal which is aluminum or an alloy thereof into said vessel;

adding a viscosity increaser to increase the viscosity of said molten metal and a foaming agent into said molten metal to produce a foamed molten metal;

mixing said viscosity increaser and said foaming agent with said molten metal in said vessel;

thereafter cooling down said molten metal to form a block of solid metal;

removing said block out of said vessel after said metal has solidified;

slicing said block in a vertical direction to its axis to form a flat panel of foamed metal having holes in positions corresponding to the positions of said rods, said holes in said panel being surrounded by foamed metal of relatively higher density.

10. A manufacturing method of making a foamed aluminum product in an open vessel having a peripheral wall, a bottom and a plurality of fixed, vertical rod members fixed to said bottom and located at positions in the vicinity of the inside surface of said peripheral wall, said peripheral wall conforming on its inside surface to the outer configuration of the foamed aluminum product, comprising:

pouring a melt of aluminum or an alloy thereof into said vessel;

stirring said melt with a viscosity increaser for increasing the viscosity of said melt and a foaming agent for foaming said melt;

cooling said melt to form a block of foamed aluminum or alloy thereof;

removing said block from said vessel; and slicing said block to a predetermined thickness in a plane vertical to its axial direction to obtain a product of foamed aluminum or aluminum alloy having a plurality of mounting holes surrounded by a high density area at least in a position in the vicinity of the outer edge thereof.

11. A foamed aluminum panel produced by the method of claim 10 in a shape conforming to an automobile engine compartment to which said foamed aluminum panel is fitted to provide heat and sound insulation.

* * * * *